US005874124A

United States Patent [19]

Adebayo et al.

[11] Patent Number: 5,874,124

[45] Date of Patent: Feb. 23, 1999

[54] PROCESS FOR METALLIZING PHOSPHOR SCREENS

[75] Inventors: Adelaide Titilayo Oluronke Morenike Adebayo, Witney; Alison Mary Wagland, Cumnor Hill; Karen Savill, Elderslie, all of United Kingdom

[73] Assignee: Cookson PLC, United Kingdom

[21] Appl. No.: 849,431

[22] PCT Filed: Nov. 27, 1995

[86] PCT No.: PCT/GB95/02761

§ 371 Date: Dec. 3, 1997

§ 102(e) Date: Dec. 3, 1997

[87] PCT Pub. No.: WO96/17369

PCT Pub. Date: Jun. 6, 1996

[30] Foreign Application Priority Data

Nov. 30, 1994 [GB] United Kingdom ..... 9424175

[51] Int. Cl.[6] ..... B05D 5/12

[52] U.S. Cl. ..... 427/64; 427/68; 427/108; 427/226; 427/404; 427/407.1; 427/407.2; 427/379; 427/385.5; 427/389.7

[58] Field of Search ..... 427/64, 68, 226, 427/404, 407.1, 407.2, 379, 385.5, 389.7, 108

[56] References Cited

U.S. PATENT DOCUMENTS 556,664 9/1896 Sasa et al. ..... 426/64

FOREIGN PATENT DOCUMENTS 2273998 7/1994 United Kingdom .

*Primary Examiner*—Janyce Bell

*Attorney, Agent, or Firm*—Mintz Levin Cohn Ferris Glovsky & Popeo P.C.

[57] ABSTRACT

A process for the metallization of phosphor screens is disclosed. The process includes the steps of coating all aqueous dispersion of a poly(hydroxyalkanoate) on a phosphor screen, allowing the screen to dry, optionally heating the screen to form a cohesive polymeric coating, depositing a layer of metal upon the coated screen to form a composite, and heating the composite to a temperature above the decomposition temperature of the poly(hydroxyalkanoate) in order to decompose and/or volatilize the film coating.

15 Claims, 2 Drawing Sheets

PROCESS FOR METALLIZING PHOSPHOR SCREENS

The present invention relates to a process of metallizing phosphor screens, in particular for cathode ray tubes (CRTs).

The electron permeable, light reflecting aluminium film on the target side of the phosphor screen of a CRT is formed by the evaporation of aluminium onto a smooth film of an organic material formed over the surface of a phosphor screen. This smooth film is subsequently burnt out to leave a mirror-like film of aluminium "tenting" across the top of the phosphor screen.

Various processes for metallizing phosphor screens have been proposed in the prior art and these can generally be classified as solvent based systems and aqueous based systems.

In the solvent based system, the phosphor layer is first wetted with an aqueous based prewet and a solvent based lacquer, comprising an approximately 2% solution of a polymer such as poly(iso-butylmethacrylate) in a solvent such as toluene, is floated on the top of the prewet. The water and solvent are removed by heating leaving a film of the polymeric material approximately 1 $\mu$m in thickness.

The major disadvantage of this approach is that it involves the use of large quantities of volatile organic solvents, such as toluene, with all the associated environmental concerns.

Aqueous based systems are described in U.S. Pat. Nos. 3,067,055, 3,582,389 and 3,582,390 in which a water-based emulsion of a water insoluble, film forming resin such as an acrylate resin copolymer is coated onto the phosphor screen, the coating is dried, the coated layer is metallized, and the coating of the resin film volatilized by heating at a temperature of up to about 450° C. The emulsion contains about 5 to 20 weight percent of the resin. In U.S. Pat. No. 3,582,389, the addition of materials to the dispersion is described. A neutralising agent is added to adjust the pH of the dispersion to the range of 4.0 to 8.0. A boric acid complex of poly (vinylalcohol) in an amount of up to 1.0% is added to reduce the blistering of the metal film over bare glass during the baking out step. Colloidal silica, in amounts of up to 25% and soluble silicates, in amounts of up to 2% are added to improve the adherence of the metallized layer to the glass and thereby reduce peeling of the metallized layer subsequent to the baking out step. In U.S. Pat. No. 4,123,563, the addition of ammonium oxalate is described to regulate the porosity of the polymer film and the metal layer. This prevents blisters on the metal film caused by the evaporation of the polymer layer. Similarly, U.S. Pat. No. 3,582,390 describes the use of hydrogen peroxide for the same purpose.

One disadvantage of the aqueous based system is that the dispersion fills all of the spaces between the phosphor strips or dots and is thus a thicker layer than in the solvent based system. Accordingly, the amount of polymer left on the screen is greater than that utilized in solvent based processes and is therefore more difficult to remove. Consequently, increased energy requirements may result from the application of extended or even multiple burn out steps. An alternative approach is to introduce oxygen into the funnel to assist burn out. This involves increased equipment costs and the hazards associated with using oxygen.

In the solvent based system as described generally above the polymer film solution and the aluminium are applied to the phosphor screen and then the funnel of a CRT is attached to the screen with a glass frit in an organic binder. It is possible to remove both the polymer film and the organic binder in one heating cycle.

In the aqueous based systems the quantities of polymer to be removed are such as to generally necessitate the bake out of the polymer film before the addition of the funnel of a CRT. Therefore two heating cycles are required with increased energy costs, and greater investment required in the number of ovens and thus also the space required on the manufacturing site.

We have now developed a process of metallizing phosphor screens which is more energy efficient than the prior art methods by utilizing a polymer that burns out at significantly lower temperatures than the acrylates and other polymers which have previously been suggested for use.

Figure 1:
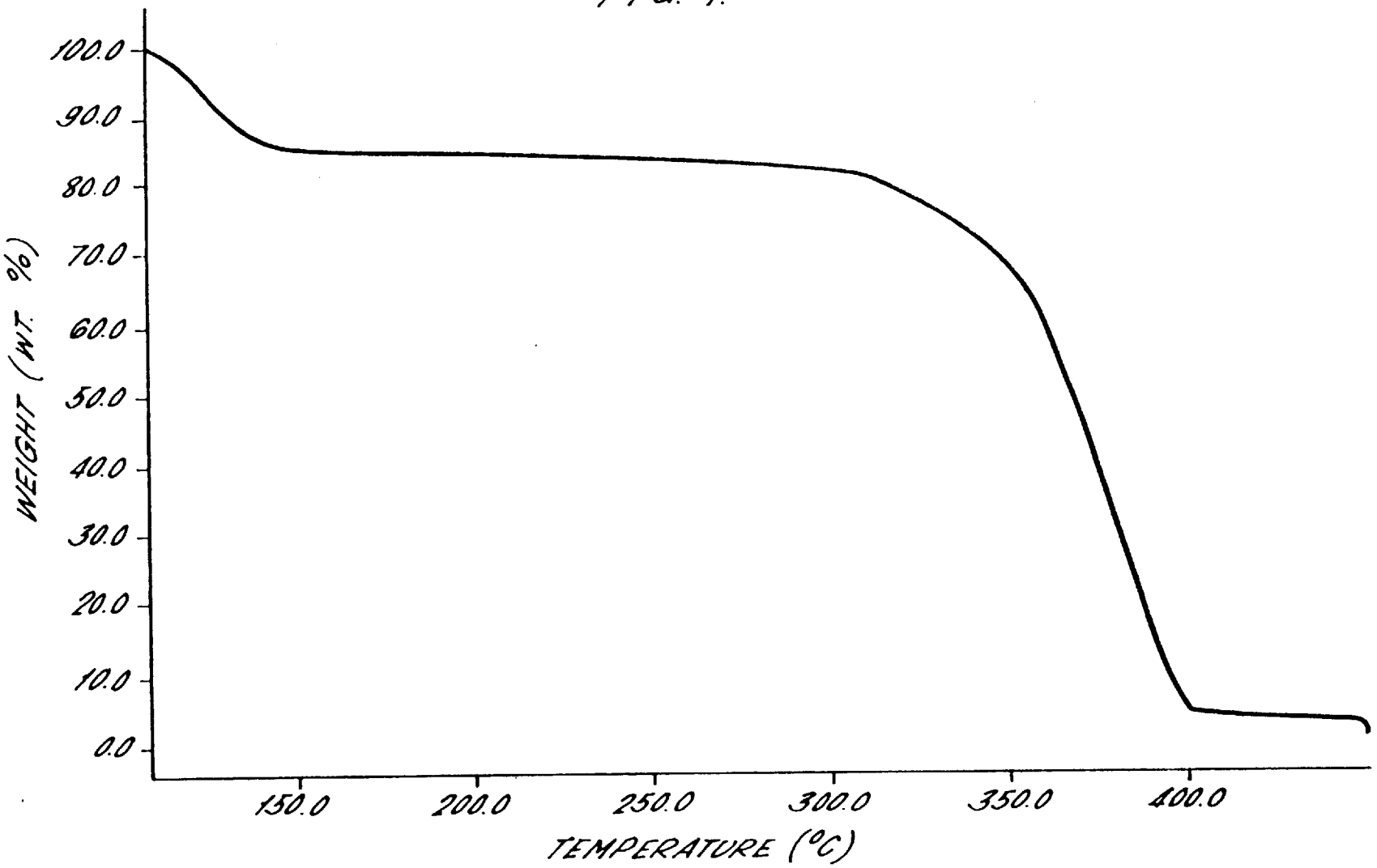
FIG. 1 is a graph showing the relative burn out temperature of a conventional methacrylate resin system.

Accordingly, the present invention provides a process for the metallization of a phosphor screen which process comprises the steps of:

i) applying to a phosphor screen a coating of an aqueous dispersion of a poly(hydroxyalkonate) and allowing the screen to dry;

ii) optionally heating the coated screen to form a polymeric coating;

iii) depositing a layer of metal upon the coated screen to form a composite; and iv) heating the composite to a temperature above the decomposition temperature of the poly(hydroxyalkanoate) in order to decompose and/or volatilise the film coating.

The phosphor screens which are metallized in accordance with the process of the present invention are generally used in the formation of cathode ray tubes, such as colour television picture tubes or display tubes. At least one and preferably three patterns of successively deposited red-emitting, green-emitting and blue-emitting phosphor strips or dots are arranged in a predetermined pattern on the innersurface of a glass panel to form a luminescent phosphor screen.

In accordance with the method of the present invention the phosphor screen is coated with the desired quantity of an aqueous dispersion of a poly(hydroxyalkanoate). The aqueous dispersion will generally contain from 1.0 to 50% by weight of the poly(hydroxyalkanoate), preferably 10 to 35% by weight of the poly(hydroxyalkanoate).

The poly(hydroxyalkanoate) is preferably poly(3-hydroxybutyrate), poly(3-hydroxyvalerate), or a copolymer of 3-hydroxybutyric acid and 3-hydroxyvaleric acid. Suitable copolymers may comprise, for example 60 to 90% by weight of 3-hydroxybutyric acid and 40 to 10% by weight of 3-hydroxyvaleric acid. Suitable poly(alkanoates) which can be made into a dispersion for use in the present invention are sold under the Trade Name Biopol (Zeneca Specialities). Alternatively, an aqueous dispersion or latex is available under the name "Biopol Aqueous Slurry" (also Zeneca Specialities).

Other additives which may be included in the dispersion are soluble silicates, colloidal silica, boric acid complex of PVA (as described in U.S. Pat. No. 3,582,389), ammonium oxalate (as described in U.S. Pat. No. 4,123,563), hydrogen peroxide (as described in U.S. Pat. No. 3,582,390), dispersing agents, defoaming agents, antifoam agents, levelling agents and/or thickening agents. The dispersing agent may be included in order to assist in maintaining the poly (hydroxyalkanoate) in suspension. The thickening agent may be included in the dispersions in order to adjust the rheological properties of the dispersion and to assist in maintaining the integrity of the dispersion on storage, i.e. to prevent the settling out of particles of the poly (hydroxyalkanoate).

The phosphor screen is coated with the poly (hydroxyalkanoate) dispersion by techniques known in the art. For example, the dispersion may be coated onto a rotating phosphor screen, optionally with tilting of the screen in order to spin off excess dispersion. The dispersion will generally be coated onto the phosphor screen in a thickness of up to 25 $\mu$m. It may be advantageous to pre-wet the phosphor screen prior to application of the coating preferably with a silicate based aqueous solution. This may improve the adhesion of the aluminium to the phosphors.

The coated phosphor screen is then heated, generally to a temperature in the range of from room temperature to 180° C., more preferably 20° to 70° C., in order to form a film of the poly(hydroxyalkanoate). During this heating process the particles of the poly(hydroxyalkanoate) in the dispersion coalesce to form the film. During the heating of the coating the coating is also partially or completely dried.

A metal layer is then deposited onto the coated screen according to techniques known in the art. For the production of CRTs the metal layer is aluminium which is preferably deposited onto the phosphor screen by vacuum evaporation. The aluminium layer preferably has a thickness in the range of from 0.1 to 0.3 $\mu$m.

After the metal layer has been deposited onto the phosphor screens to form a composite, the composite is then heated to a temperature above the decomposition temperature of the poly(hydroxyalkanoate) in order to burn out and volatilize the polymeric film coating. The poly (hydroxyalkanoate) decomposes on heating to leave little or no residue. The most preferred poly(hydroxy-alkanoates) for use in the present invention volatilise or decompose at a temperature of below about 350° C.

Figure 2:
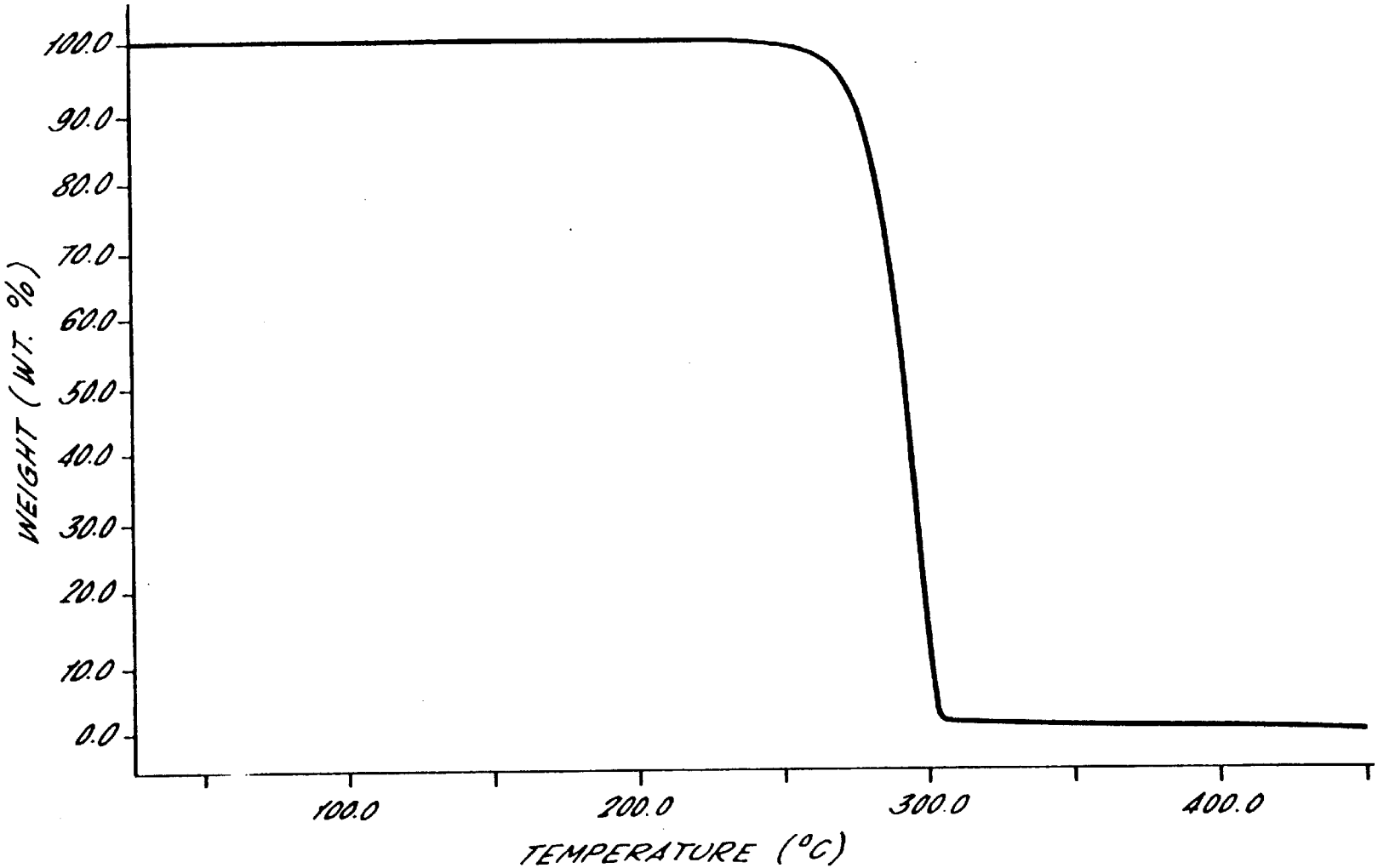
FIG. 2 is a graph showing the relative burn out temperature of a poly(3-hydroxybutyric acid)/poly(3-hydroxyvaleric acid) copolymer resin system.

A comparison of the relative burn out temperatures of a conventional methacrylate resin system (Rhoplex B74) and a poly(3-hydroxybutyric acid)/poly(3-hydroxyvaleric acid) copolymer comprising 12 wt % of poly(3-hydroxyvaleric acid) are shown in FIGS. 1 and 2 of the accompanying drawings. The results shown in FIGS. 1 and 2 were obtained by heating the samples at 10° C./minute from room temperature and using a Perkin-Elmer 6 series Thermal Analysis System to record the weight loss.

In putting the process of the present invention into practice, the heating of the composite in step (iv) may be combined with the step of sealing a cathode ray tube to the phosphor screen, i.e. a separate baking step to volatilise the polymeric film coating becomes unnecessary. The sealing of a cathode ray tube to a metallized phosphor screen is well known in the art, the seal generally being effected by using a frit sealing process in which a glass frit in an organic binder is used to seal the components together. The oxygen which is present in the cathode ray tube is generally sufficient to assist in the burn out of the polymeric film coating, although it will be understood that additional air or oxygen-enriched air may be introduced into the cathode ray tube, as necessary. The frit sealing of the metallized phosphor screen to the cathode ray tube will generally occur at a temperature of about 450° C. The conventional temperature profile for the sealing cycle is termed a Lehr cycle.

The present invention includes within its scope a phosphor screen which has been metallized by the process of the invention and a cathode ray tube which includes at least one phosphor screen which has been metallized by the process of the invention.

The present invention will be further described with reference to the following Examples in which the following definition is used.

Lehr Cycle

The Lehr cycle use in the following Examples is as follows: heat from room temperature to 450° C. at 10° C./min, hold at 450° C. for 45 minutes and then cool to room temperature.

EXAMPLE 1

A 3"×3" pre-cut square of colour TV screen was spun horizontally (with the phosphor side facing upwards) on its axis at 160 r.p.m. for 20 seconds. During this time, ca 10 ml of 29% w/w solids 1 $\mu$m mean particle size Biopol latex (supplied by Zeneca, Specialities batch No: BPL No. 505/1001) was slurried directly onto the spinning TV screen. The screen was re-spun at 160 r.p.m. for 20 seconds to remove excess latex and dried in air at room temperature. The screen was aluminised using an Edwards Coating System E306A. A 1 inch piece of 99.99% pure aluminium wire (0.58 mm diameter) was vaporised at $1.5\times10^{-5}$ mbar to produce an aluminium coating on the TV screen. The screen was heated under the conditions of the Lehr cycle to leave a shiny flat aluminium film adhering to the phosphors.

EXAMPLE 2

A 3"×3" pre-cut square of colour TV screen was spun horizontally (with the phosphor side facing upwards) on its axis at 160 r.p.m. for 20 seconds. During the time, ca 10 ml 15% w/w solids 1 $\mu$m mean particle size Biopol latex (diluted with water from 29% to 15% w/w solids) (supplied by Zeneca Specialities batch No: BPL No. 505/1001) was slurried directly onto the spinning TV screen. The screen was re-spun at 160 r.p.m. for 20 seconds to remove excess latex and dried in air at room temperature. The screen was aluminised using an Edwards Coating System E306A. A 1 inch piece of 99.99% pure aluminium wire (0.58 mm diameter) was vaporised at $1.5\times10^{-5}$ mbar to produce an aluminium coating on the TV screen. The screen was heated under the conditions of the Lehr cycle to leave a shiny flat aluminium film adhering to the phosphors.

EXAMPLE 3

A 3"×3" pre-cut square of colour TV screen was spun horizontally (with the phosphor side facing upwards) on its axis at 160 r.p.m. for 20 seconds. During the time, ca 10 ml of 42% w/w solids of 0.5 $\mu$m mean particle size Biopol latex (supplied by Zeneca Specialities batch No: BPL No. 509/2701) was slurred directly onto the spinning TV screen. The screen was re-spun at 160 r.p.m. for 20 seconds to remove excess latex and dried in air at room temperature. The screen was aluminised using an Edwards Coating System E306A. A 1 inch piece of 99.99% pure aluminium wire (0.58 mm diameter) was vaporised at $1.5\times10^{-5}$ mbar to produce an aluminium coating on the TV screen. The screen was heated under the conditions of the Lehr cycle to leave a shiny flat aluminium film adhering to the phosphors.

EXAMPLE 4

A 3"×3" pre-cut square of colour TV screen was spun horizontally (with the phosphor side facing upwards) on its axis at 160 r.p.m. for 20 seconds. During this time, ca 10 ml of 32% w/w solids of 0.5 $\mu$m mean particle size Biopol latex (supplied by Zeneca Specialities batch No: BPL No. 509/2001) was slurried directly onto the spinning TV screen. The screen was re-spun at 160 r.p.m. for 20 seconds to remove excess latex and dried in air at room temperature. The screen was aluminised using an Edwards Coating System E306A.

A 1 inch piece of 99.99% pure aluminium wire (0.58 mm diameter) was vaporised at $1.5\times10^{-5}$ mbar to produce an aluminium coating on the TV screen. The screen was heated under the conditions of the Lehr cycle to leave a shiny flat aluminium film adhering to the phosphors.

EXAMPLE 5

Biopol powder D600G (supplied by Zeneca Specialities) was wet-milled using a continuous flow process in an attritor mill (supplied by Dyno Mill type KDL). The Biopol (1 kg) was added gradually to water (3 litres) and the dispersion was stirred throughout the milling process. A pump controlled the flow-rate of the Biopol dispersion through the mill. Initially, the pump setting was 20 ml/minute to obtain a coarse milling and it was then slowed to 5 ml/minute. The particle size of the Biopol milled in this manner measured 1 μm in diameter (SEM). The milled Biopol settled and was collected as a cake, which was a 1:1 Biopol:water mixture.

A Biopol dispersion was prepared from the following ingredients:

| | |
|---|---|
| Biopol cake | 7.5 g |
| Dow Corning additive D65 | 0.03 g |
| Synperonic PE F/68 (ICI) | 0.1 g |
| Rheovis CR3 (Allied Colloids) | 0.12 g |
| Deionised water | 19.75 g |

The Biopol cake was added to a solution of Dow Corning additive D65 and Synperonic PE F/68 and the mixture stirred at room temperature for 5 minutes using a Silverson Laboratory Mixer. A thickener, Rheovis CR3, was added to the mixture which was then stirred for a further 5 minutes. Ammonium hydroxide (25 wt %) was used to adjust the pH of the dispersion to 8 to 9.5 and the mixture was stirred for 3 minutes. The resultant dispersion was stable for four months.

A 3"×3" pre-cut square of colour TV screen was wetted with a sodium silicate based prewet solution. The Biopol dispersion produced as detailed above was diluted to 10 wt % Biopol by the addition of deionised water. An 8 ml sample of the dispersion was spin coated onto the 3"×3" pre-wetted TV screen at 80 rpm. The coated screen was then heat-treated in an oven set at 180° C. for 12 minutes to form a uniform film of Biopol on the screen.

Aluminium was vapour deposited onto the screen produced as described above using the Edwards Coating System E 306A. The screen was heated under a typical Lehr cycle up to a maximum of about 450° C. During this heating cycle, the organic substances in the Biopol film volatilised leaving a mirror finish of aluminium on the screen.

EXAMPLE 6

Biopol cake, prepared according to Example 5 (7.5 g) was added to a solution of antifoam DNE-Bayer (0.075 g) and Tagat L2-Goldschmidt (0.25 g) in water (11.75 g). The mixture was stirred for 2 minutes with a paddle mixer at 500 rpm. Viscalex HV 30-Allied Colloids (0.3 g) was added and the mixture was stirred for a further minute. The pH of the dispersion was adjusted to 8 to 9.5 using ammonium hydroxide (25 wt %). An 8 ml sample of this dispersion was used to coat a 3"×3" TV screen as described in Example 1. The coated screen was then heat-treated in an oven set at 180° C. for 12 minutes to form a uniform film of Biopol on the screen.

Aluminium was vapour deposited onto the screen produced as described above using the Edwards Coating Systems E306A. The screen was heated under a Lehr cycle to a maximum of about 450° C. During this heating cycle, the organic substances in the Biopol film volatilised leaving a mirror finish of aluminium on the screen.

We claim:

1. A process for the metallization of a phosphor screen which process comprises the steps of:

i) applying to a phosphor screen a coating of an aqueous dispersion of a poly(hydroxyalkanoate) and allowing the screen to dry;

ii) optionally heating the coated screen to form a coherent polymeric coating;

iii) depositing a layer of metal upon the coated screen to form a composite; and iv) heating the composite to a temperature above the decomposition temperature of the poly (hydroxyalkanoate) in order to decompose and/or volatilise the film coating.

2. A process as claimed in claim 1 wherein the poly (hydroxyalkanoate) is a poly(3-hydroxybutyrate), a poly(3-hydroxyvalerate) or a copolymer of 3-hydroxybutyric acid and 3-hydroxyvaleric acid.

3. A process as claimed in claim 2 wherein the aqueous dispersion coated onto the phosphor screen comprises from 10 to 35% by weight of the poly(hydroxyalkanoate).

4. A process as claimed in claim 1 or claim 2 wherein the aqueous dispersion coated onto the phosphor screen comprises from 1.0 to 50.0% by weight of the poly (hydroxyalkanoate).

5. A process claimed in claim 1 wherein the dried coating of poly(hydroxyalkanoate) has a thickness of up to 25 μm.

6. A process claimed in claim 1 wherein the coated screen is heated in step (ii) under conditions such that a coherent polymeric film is formed in the phosphor screen.

7. A process as claimed in claim 1 wherein the metal which is deposited upon the coated screen is aluminium.

8. A process as claimed in claim 6 wherein the layer of aluminium is deposited upon the coated screen by vacuum evaporation.

9. A process as claimed in claim 7 wherein the layer of aluminium has a thickness in the range of from 0.1 to 0.3 μm.

10. A process as claimed in claim 1 wherein the volatilisation decomposition of the poly(hydroxyalkanoate) is effected at a temperature of below 350° C.

11. A process as claimed in claim 1 wherein the aqueous dispersion additionally includes therein hydrogen peroxide.

12. A process as claimed in claim 1 wherein the aqueous dispersion additionally, includes therein one or more of a soluble silicate, colloidal silica, a dispersing agent, an anti-foaming agent, a defoaming agent, a levelling agent or a thickening agent.

13. A process as claimed in claim 1 wherein the heating of the composite in step (iv) is effected during the sealing of a funnel of a cathode ray tube to the phosphor screen.

14. A process as claimed in claim 13 wherein a maximum temperature reached during the sealing step is about 450° C.

15. A process as claimed in claim 1 wherein the aqueous dispersion coated onto the phosphor screen comprises from 10 to 35% by weight of the poly(hydroxyalkanoate).

* * * * *